US009341070B2

(12) United States Patent
Aiello et al.

(10) Patent No.: US 9,341,070 B2
(45) Date of Patent: May 17, 2016

(54) SHIELD SLOT ON SIDE OF LOAD SLOT IN GAS TURBINE ENGINE ROTOR

(75) Inventors: Nicholas Aiello, New Haven, CT (US); James Cosby, Glastonbury, CT (US); Kevin L. Corcoran, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 1023 days.

(21) Appl. No.: 13/483,139

(22) Filed: May 30, 2012

(65) Prior Publication Data

US 2013/0319004 A1 Dec. 5, 2013

(51) Int. Cl.
*F01D 5/30* (2006.01)
*F01D 5/32* (2006.01)

(52) U.S. Cl.
CPC . *F01D 5/303* (2013.01); *F01D 5/32* (2013.01)

(58) Field of Classification Search
CPC ..... F01D 5/32; F01D 5/303; F01D 5/3038; Y10T 29/49321; F05D 2260/30
See application file for complete search history.

(56) References Cited

U.S. PATENT DOCUMENTS 3,902,824 A 9/1975 Sauer
4,859,149 A 8/1989 McClain
5,151,013 A 9/1992 Moore
5,211,537 A 5/1993 Langston et al.
5,522,706 A 6/1996 Mannava et al.
6,471,483 B2 * 10/2002 London ..... 416/215
7,144,218 B2 12/2006 Dube et al.
7,901,187 B2 3/2011 Barber
2009/0274552 A1 11/2009 Konter et al.
2011/0116933 A1 5/2011 Aiello

OTHER PUBLICATIONS

International Preliminary Report on Patentability for International Application No. PCT/US2013/041066 mailed Dec. 11, 2014.
International Search Report and Written Opinion for International Application No. PCT/US2013/041066 completed on Mar. 4, 2014.

* cited by examiner

*Primary Examiner* — Phutthiwat Wongwian
*Assistant Examiner* — Stefan Ibroni
(74) *Attorney, Agent, or Firm* — Carlson, Gaskey & Olds, PC

(57) ABSTRACT

A rotor body rotates about an axis of rotation. A ledge provides a holding structure for holding blades. A plurality of blades are positioned beneath the ledge. A load slot is sized to allow a mount portion of the blades to be moved radially inwardly of the ledge. The blades are moved circumferentially to have the mounted structure radially inwardly of the ledge. A lock slot is positioned on one circumferential side of the load slot. The lock slot is formed to receive a lock, and the lock is partially received within a portion of at least one of the blades, to lock the blades within the rotor, and a shield slot on a second circumferential side of the load slot. The shield slot is sized to be different from the lock slot such that a lock cannot be inadvertently positioned within the shield slot.

22 Claims, 2 Drawing Sheets

SHIELD SLOT ON SIDE OF LOAD SLOT IN GAS TURBINE ENGINE ROTOR

BACKGROUND OF THE INVENTION

This application relates to an arrangement of slots in a rotor as utilized in a gas turbine engine.

Gas turbine engines are known, and typically include a compressor section that compresses air and delivers it downstream into a combustion section. The air is mixed with fuel and ignited, and products of the combustion pass downstream over turbine rotors, driving them to rotate.

Both the compressor and the turbine include rotors that can carry removable blades. In one type of blade arrangement, the blades have a mount portion, or dovetail, which is mounted underneath a ledge in the rotor. So-called "load slots" allow the dovetail to be inserted past the ledge, and the blade is then turned, such that the blade can no longer move outwardly of the ledge. The blades are then moved circumferentially to be aligned with the adjacent blades.

The ledge typically also includes a lock slot. A plurality of locks are inserted into openings in at least some of the blades, and are mechanically loaded radially outward to lock the blade within the ledge. The lock slots and the load slots are each formed in the ledge.

At times, there may be an arrangement of locks and lock slots such that there is a lock slot adjacent to a load slot on one circumferential side, but not the other. This can raise stress concentrations around the load slot which are somewhat undesirable.

SUMMARY OF THE INVENTION

In one featured embodiment, a rotor for use in a gas turbine engine has a rotor body for rotation about an axis of rotation. The rotor body extends circumferentially about the axis of rotation, and also has an axial direction along the axis of rotation. A ledge provides a holding structure for holding blades radially inwardly of the ledge. A plurality of blades have mount structure positioned beneath the ledge. The blades have an airfoil extending upwardly from a platform. The mount structure extends inwardly from the platform. A load slot in the ledge is sized to allow the mount structure of the blades to be moved radially inwardly of the ledge by positioning the mounting structure to move through the load slot. The blades then are moved circumferentially to have the mount structure radially inwardly of the ledge. A lock slot in the ledge is on one circumferential side of the load slot. The lock slot receives a lock. The lock is being partially received within a portion of at least one of the blades, and a shield slot in the ledge is on a second circumferential side of the load slot. The shield slot is sized to be different from the lock slot such that a lock cannot be inadvertently positioned within the shield slot.

In another embodiment according to the previous embodiment, the shield slot and lock slot each extend axially into the ledge for a depth, with a depth of the shield slot being less than a depth of the lock slot.

In another embodiment according to any of the previous embodiments, each of the lock slot and shield slot are curved portions each formed at at least one radius.

In another embodiment according to any of the previous embodiments, the curved portions of both the lock slot and shield slot are part circular portions.

In another embodiment according to any of the previous embodiments, a radius of the lock slot is greater than a radius of the shield slot.

In another embodiment according to any of the previous embodiments, a circumferential distance from a circumferential edge of the load slot most adjacent the lock slot to an edge of the lock slot most adjacent the load slot is defined as a first distance, and a second distance is defined from a circumferential edge of the load slot closest to the shield slot, to an edge of the shield slot most adjacent to the load slot, with the second distance being less than the first distance.

In another embodiment according to any of the previous embodiments, each of the lock slot and shield slot are curved portions each formed at at least one radius.

In another embodiment according to any of the previous embodiments, the curved portions of both the lock slot and shield slot are part circular portions.

In another embodiment according to any of the previous embodiments, a radius of the lock slot is greater than a radius of the shield slot.

In another embodiment according to any of the previous embodiments, a circumferential distance from a circumferential edge of the load slot most adjacent the lock slot to an edge of the lock slot most adjacent the load slot is defined as a first distance, and a second distance is defined from a circumferential edge of the load slot closest to the shield slot, to an edge of the shield slot most adjacent to the load slot, with the second distance being less than the first distance.

In another featured embodiment, a gas turbine engine has a compressor, a combustion section, and a turbine section. The compressor section includes at least a first compressor rotor and a rotor body for rotation about an axis of rotation. The rotor body extends circumferentially about the axis of rotation, and also has an axial direction along the axis of rotation. A ledge provides a holding structure for holding blades radially inwardly of the ledge. A plurality of blades have mount structure positioned beneath the ledge. The blades have an airfoil extending upwardly from a platform. The mount structure extends inwardly from the platform. A load slot in the ledge is sized to allow the mount structure of the blades to be moved radially inwardly of the ledge by positioning the mounting structure to move through the load slot. The blades are then moved circumferentially to have the mount structure radially inwardly of the ledge. A lock slot in the ledge is on one circumferential side of the load slot. The lock slot receives a lock, and is also partially received within a portion of at least one of the blades. A shield slot in the ledge is on a second circumferential side of the load slot and is sized to be different from the lock slot such that a lock cannot be inadvertently positioned within the shield slot.

In another embodiment according to the previous embodiment, the shield slot and lock slot each extend axially into the ledge for a depth. The depth of the shield slot is less than a depth of the lock slot.

In another embodiment according to any of the previous embodiments, each of the lock slot and shield slot are curved portions each formed at at least one radius.

In another embodiment according to any of the previous embodiments, the curved portions of both the lock slot and shield slot are part circular portions.

In another embodiment according to any of the previous embodiments, a radius of the lock slot is greater than a radius of the shield slot.

In another embodiment according to any of the previous embodiments, a circumferential distance from a circumferential edge of the load slot most adjacent the lock slot to an edge of the lock slot most adjacent the load slot is defined as a first distance. A second distance is defined from a circumferential edge of the load slot closest to the shield slot, to an edge of the shield slot most adjacent to the load slot, with the second distance being less than the first distance.

In another embodiment according to any of the previous embodiments, each of the lock slot and shield slot are curved portions each formed at at least one radius.

In another embodiment according to any of the previous embodiments, the curved portions of both the lock slot and shield slot are part circular portions.

In another embodiment according to any of the previous embodiments, a radius of the lock slot is greater than a radius of the shield slot.

In another embodiment according to any of the previous embodiments, a circumferential distance from a circumferential edge of the load slot most adjacent the lock slot to an edge of the lock slot most adjacent the load slot is defined as a first distance, and a second distance is defined from a circumferential edge of the load slot closest to the shield slot, to an edge of the shield slot most adjacent to the load slot, with the second distance being less than the first distance.

These and other features of this application will be best understood from the following specification and drawings, the following of which is a brief description.

DETAILED DESCRIPTION

Figure 1:
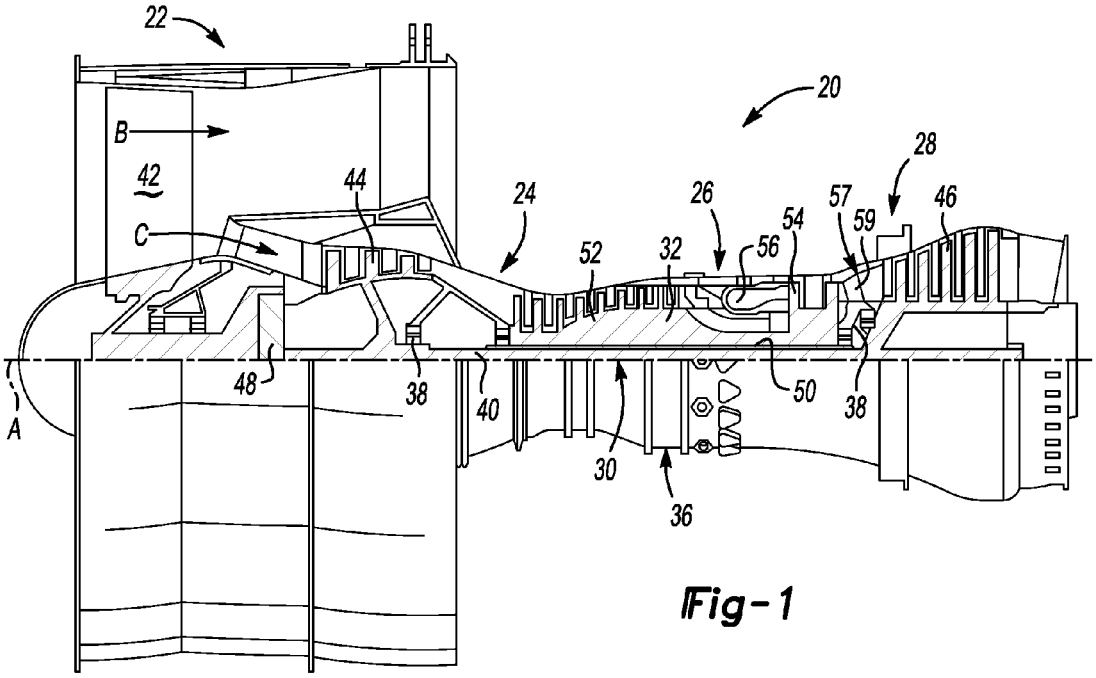
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives some air along a bypass flowpath B but also drives air along a core flowpath C for compression in the compressor section 24, and into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including one-spool or three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tambient deg R)/518.7)^0.5]. The "Low corrected fan tip speed" as disclosed herein according to one non-limiting embodiment is less than about 1150 ft/second.

Figure 2A:
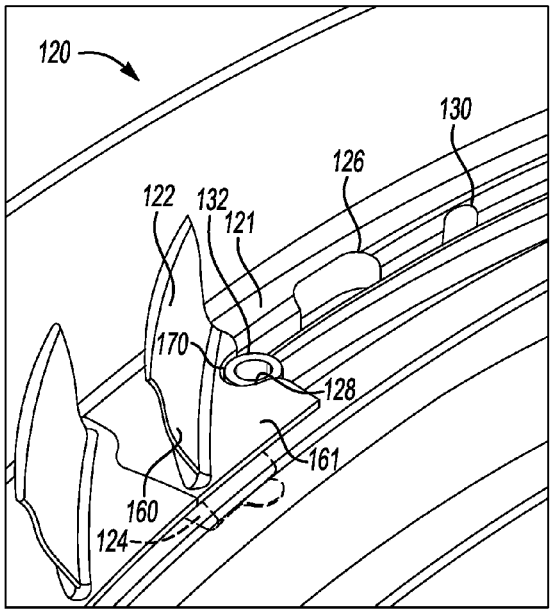
FIG. 2A shows a portion of a compressor section.

FIG. 2A shows a portion of a compressor rotor 120 which may be incorporated into the FIG. 1 engine. As shown, a plurality of blades 122 have an airfoil section 160 extending upwardly of a platform 161. A locking section or dovetail 124 is radially inward of the platform 161. A ledge 121 extends axially away from an inner portion of rotor 120, and includes a so-called "load slot" 126. The load slot allows the dovetail 124 to move inwardly past the ledge 121, at which time the blade 122 may be turned, and then move circumferentially to be in contact with an adjacent blade. Additional blades are inserted until they fill all of the space, as shown in FIG. 2A.

Details of a structure which may include the load slots and lock slots are illustrated in Published Patent Application U.S. 2011-0116933 A1, filed by the inventor of the present application. The operation and structure of the load and lock slots, along with the blades and locks as detailed in that application are incorporated herein by reference, but other load slot and lock slot structures may also apply.

A plurality of locks 128 are inserted into an opening space 170 in the platform 161 in at least some of the blades. There are typically many more blades than there are locks, thus, not all of the blades have a platform opening 170. In addition, the ledge 121 includes a lock slot 132. At times, the lock slots may be mounted circumferentially symmetrically about a load slot 126. However, at other times there may be a lock slot on one circumferential side of a load slot 126, but not the other.

As shown in FIG. 2A, in such a circumstance, a shield slot 130 is formed on an opposed circumferential side from the lock slot 132.

Figure 2B:
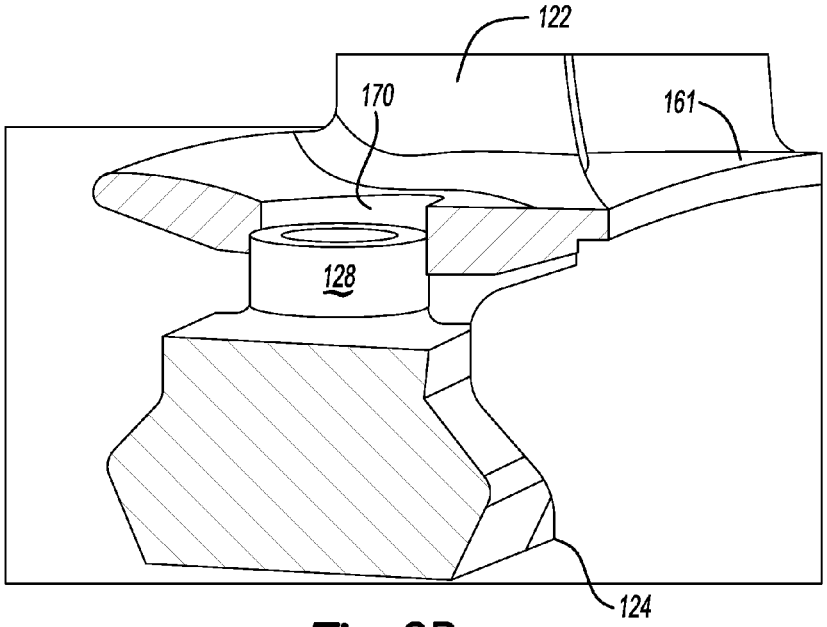
FIG. 2B shows a detail of lock structure.

FIG. 2B shows a detail of the lock 128 being received within the slot 170 in the blade 122. The dovetail 124 is seen inwardly of the platform 161 in this view.

Figure 3:
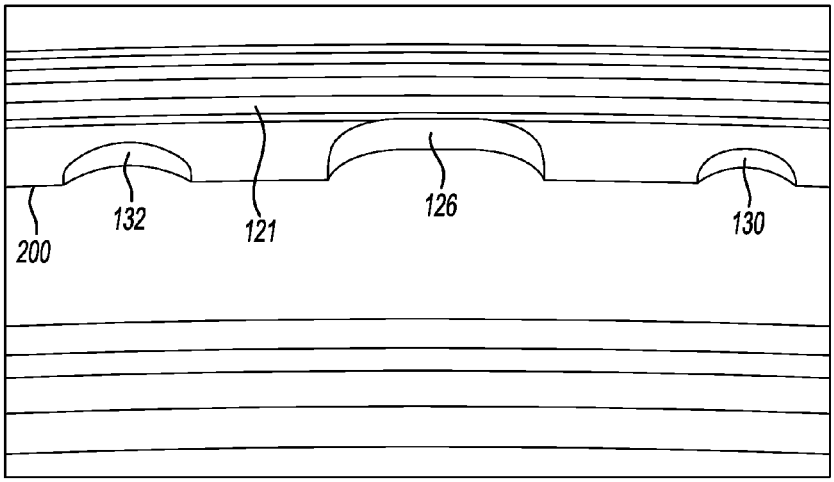
FIG. 3 shows a detail of a rotor.
Figure 4:
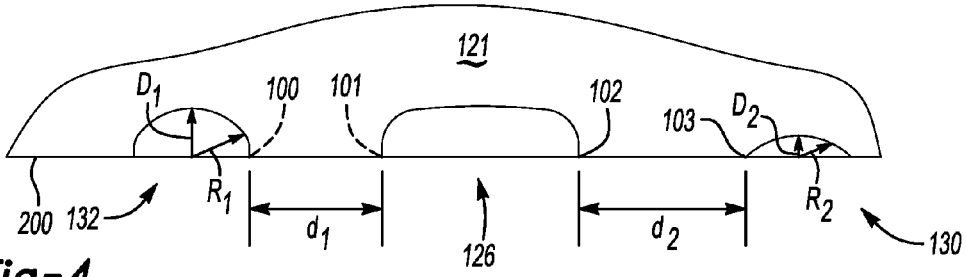
FIG. 4 shows geometric relationships in the FIG. 3 structure.

FIG. 3 shows the load slot 126, the lock slot 132, and the shield slot 130. FIG. 4 shows geometric details of the slots 132 and 130. As shown, the lock slot 132 extends inwardly for a depth $D_1$, and is formed at a radius $R_1$.

The depth is defined as the greatest distance within the slot measured away from an outer edge 200. As can be appreciated, the slots 132 and 130 are formed along a curve. In the disclosed embodiment, the slots are part-circular, and thus form at a single radius, but may be other single or multiple curved shapes with or without non-curved sections.

The lock slot 132 has a circumferential edge 100 spaced from the closest circumferential edge 101 of the load slot 126 by a distance $d_1$. An opposed edge 102 of the load slot is spaced from a most adjacent circumferential edge 103 of the shield slot 130 by a distance $d_2$. The shield slot 130 extends for a depth $D_2$, and is formed at a radius $R_2$. In embodiments, the depth $D_2$ is less than the depth $D_1$. This will make it less likely that a lock would inadvertently be inserted into a shield slot 130. In addition, some means of shifting the effect of the shield slot 130 may be incorporated. One method may be increasing the distance $d_2$ relative to the distance $d_1$. Another method may be making the radius $R_2$ smaller than the radius $R_1$. Of course, shield slot 130 could be made larger than the lock slot in any of these dimensions.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A rotor for use in a gas turbine engine comprising:

a rotor body, said rotor body for rotation about an axis of rotation and said rotor body extending circumferentially about said axis of rotation, and also having an axial direction along said axis of rotation;

a ledge to provide a holding structure for holding blades radially inwardly of said ledge;

a plurality of blades have mount structure positioned beneath said ledge, said blades having an airfoil extending upwardly from a platform, and said mount structure extending inwardly from said platform;

a load slot in said ledge, said load slot being sized to allow said mount structure of said blades to be moved radially inwardly of said ledge by positioning said mounting structure to move through said load slot, and said blades then being moved circumferentially to have said mount structure radially inwardly of said ledge; and a lock slot in said ledge on one circumferential side of said load slot, said lock slot receiving a lock, said lock also being partially received within an opening in said platform of at least one of said blades, said lock being separate from said blade and inserted into said opening, and a shield slot in said ledge on a second circumferential side of said load slot, said shield slot being sized to be different from said lock slot such that a lock cannot be inadvertently positioned within said shield slot.

2. The rotor as set forth in claim 1, wherein said shield slot and said lock slot each extend axially into said ledge for a depth, with a depth of said shield slot being less than a depth of said lock slot.

3. The rotor as set forth in claim 2, wherein each of said lock slot and said shield slot are curved portions each formed at at least one radius.

4. The rotor as set forth in claim 3, wherein said curved portions of both said lock slot and said shield slot are part circular portions.

5. The rotor as set forth in claim 4, wherein a radius of said lock slot is greater than a radius of said shield slot.

6. The rotor as set forth in claim 2, wherein a circumferential distance from a circumferential edge of said load slot most adjacent said lock slot to an edge of said lock slot most adjacent said load slot is defined as a first distance, and a second distance is defined from a circumferential edge of said load slot closest to said shield slot, to an edge of said shield slot most adjacent to said load slot, with said second distance being less than said first distance.

7. The rotor as set forth in claim 1, wherein each of said lock slot and said shield slot are curved portions each formed at at least one radius.

8. The rotor as set forth in claim 7, wherein said curved portions of both said lock slot and said shield slot are part circular portions.

9. The rotor as set forth in claim 8, wherein a radius of said lock slot is greater than a radius of said shield slot.

10. The rotor as set forth in claim 1, wherein a circumferential distance from a circumferential edge of said load slot most adjacent said lock slot to an edge of said lock slot most adjacent said load slot is defined as a first distance, and a second distance is defined from a circumferential edge of said load slot closest to said shield slot, to an edge of said shield slot most adjacent to said load slot, with said second distance being less than said first distance.

11. The rotor as set forth in claim 1, wherein there are a greater number of said plurality of blades than there are said locks.

12. A gas turbine engine comprising:

a compressor, a combustion section, and a turbine section; and said compressor section, including at least a first compressor rotor, a rotor body for rotation about an axis of rotation and said rotor body extending circumferentially about said axis of rotation, and also having an axial direction along said axis of rotation;

a ledge to provide a holding structure for holding blades radially inwardly of said ledge;

a plurality of blades have mount structure positioned beneath said ledge, said blades having an airfoil extending upwardly from a platform, and said mount structure extending inwardly from said platform;

a load slot in said ledge, said load slot being sized to allow said mount structure of said blades to be moved radially inwardly of said ledge by positioning said mounting structure to move through said load slot, and said blades then being moved circumferentially to have said mount structure radially inwardly of said ledge; and a lock slot in said ledge on one circumferential side of said load slot, said lock slot receiving a lock, said lock also being partially received within an opening in said platform of at least one of said blades, said lock being separate from aid blade and inserted into said opening, and a shield slot in said ledge on a second circumferential side of said load slot, said shield slot being sized to be different from said lock slot such that a lock cannot be inadvertently positioned within said shield slot.

13. The engine as set forth in claim 12, wherein said shield slot and said lock slot each extend axially into said ledge for a depth, with a depth of said shield slot being less than a depth of said lock slot.

14. The engine as set forth in claim 13, wherein each of said lock slot and said shield slot are curved portions each formed at at least one radius.

15. The engine as set forth in claim 14, wherein said curved portions of both said lock slot and said shield slot are part circular portions.

16. The engine as set forth in claim 15, wherein a radius of said lock slot is greater than a radius of said shield slot.

17. The engine as set forth in claim 13, wherein a circumferential distance from a circumferential edge of said load slot most adjacent said lock slot to an edge of said lock slot most adjacent said load slot is defined as a first distance, and a second distance is defined from a circumferential edge of said load slot closest to said shield slot, to an edge of said shield slot most adjacent to said load slot, with said second distance being less than said first distance.

18. The engine as set forth in claim 12, wherein each of said lock slot and said shield slot are curved portions each formed at at least one radius.

19. The engine as set forth in claim 18, wherein said curved portions of both said lock slot and said shield slot are part circular portions.

20. The engine as set forth in claim 19, wherein a radius of said lock slot is greater than a radius of said shield slot.

21. The engine as set forth in claim 12, wherein a circumferential distance from a circumferential edge of said load slot most adjacent said lock slot to an edge of said lock slot most adjacent said load slot is defined as a first distance, and a second distance is defined from a circumferential edge of said load slot closest to said shield slot, to an edge of said shield slot most adjacent to said load slot, with said second distance being less than said first distance.

22. The engine as set forth in claim 12, wherein there are a greater number of said plurality of blades than there are said locks.

* * * * *